United States Patent [19]

Vandelinde

[11] Patent Number: 4,513,952

[45] Date of Patent: Apr. 30, 1985

[54] DRIVE MECHANISM FOR CABLE DRUMS

[75] Inventor: Henry Vandelinde, Scarborough, Canada

[73] Assignee: Swing Stage Limited, Scarborough, Canada

[21] Appl. No.: 501,334

[22] Filed: Jun. 6, 1983

Related U.S. Application Data

[63] Continuation-in-part of Ser. No. 288,588, Jul. 30, 1981, abandoned.

[30] Foreign Application Priority Data

Oct. 5, 1982 [EP] European Pat. Off. ..... 82305294.9

[51] Int. Cl.[3] ..... B66D 1/14; B66D 5/04

[52] U.S. Cl. ..... 254/285; 254/294; 254/322; 254/376; 242/99; 242/158.3; 74/68; 182/239; 188/180

[58] Field of Search ..... 254/284, 285, 294, 321, 254/322, 366, 376, 378, 267; 74/67, 68; 242/84.52 C, 99, 107.3, 158.3; 182/234, 239; 188/180, 184, 185, 186, 187, 188, 189

[56] References Cited

U.S. PATENT DOCUMENTS

| | | | |
|---|---|---|---|
| 1,097,078 | 5/1914 | Box | 254/322 X |
| 2,505,088 | 4/1950 | Athy | 254/285 |
| 2,546,202 | 3/1951 | Trouin | 242/107.3 |
| 3,069,915 | 12/1962 | Sawle | 74/68 |
| 3,332,634 | 7/1967 | Somervell et al. | 242/158.3 X |
| 4,199,133 | 4/1980 | Gagnon | 254/378 X |

FOREIGN PATENT DOCUMENTS

| | | | |
|---|---|---|---|
| 2907111 | 9/1979 | Fed. Rep. of Germany | 254/378 |

*Primary Examiner*—John M. Jillions
*Assistant Examiner*—Joseph J. Hail, III
*Attorney, Agent, or Firm*—Arne I. Fors; Robert F. Delbridge

[57] ABSTRACT

A drum hoist or winch in which at least one circular cam lobe mounted eccentrically on an axle overlapping the axle is interconnected with a like circular cam lobe mounted on a second axle by inboard linkage whereby rotation of one axle will rotate the other axle in unison. A hoist drum mounted concentrically with at least one of the axles can thus be rotated in unison with the other axle to wind or unwind one or more cables thereon.

A preferred embodiment has three circular cam lobes mounted eccentrically on each axle 120° angularly out of phase with each other with an inboard link plate interconnecting a cam lobe on each axle in rotatable relation.

A brake mechanism mounted on an axle has components normally frictionally engaged which rotate as a unit. Sliding frictional motion to slow down and positively brake the hoist to a stop is provided only when rotary speed of the axle exceeds a predetermined speed.

5 Claims, 17 Drawing Figures

DRIVE MECHANISM FOR CABLE DRUMS

This application is a continuation-in-part of application Ser. No. 288,588 filed July 30, 1981 which is now abandoned.

This invention relates to a drum hoist and, more particularly, relates to an improved drum hoist or winch of the type used for raising and lowering platforms and scaffolds.

Drum hoists and drive mechanisms for operating hoists are well known for raising and lowering scaffolds used in washing windows on the exterior of tall buildings and in mines and within buildings to raise and lower mine cages and elevator compartments. Conventional drive mechanisms comprise a drum journalled in a support frame having a shaft connected to a gear mechanism which is in turn connected to a gear reducer and a drive motor. The failure of a single tooth in the drive gears can immobilize the hoist and, to avoid loss of control of the hoist drums, each drum normally has a brake mechanism connected thereto. The drive mechanisms thus often are complex in structure and expensive to manufacture.

Regulations usually require hoisting cables be wound on a drum in a single layer. This necessitates, for a 500 foot building having a scaffold suspended by four cables, at least 2000 feet of cable wound on drums in one layer. Although the use of multiple drums in place of a single large drum provides a more compact arrangement, the increased cost of a gear train for the multiple-drum arrangement and individual emergency brake systems for each drum has been prohibitively expensive. In that a gear train can fail by the loss of a single gear component, and in that several emergency brake systems can be quite complex requiring careful maintenance, safety considerations for multiple drum assemblies become of concern.

The use of a mechanical linkage system for enabling two spaced, rotatable objects to move together in unison is known. For example, U.S. Pat. No. 3,229,807 discloses a mechanical linkage incorporating a pair of spaced-apart pivot axles having cam members mounted thereon with an interconnecting link, the eccentricity of the cam members being sufficiently small that both a lever and manual rotation means must be moved in a common direction to enable movement of the lever.

It has been found that the combination of at least one cam lobe mounted eccentrically on an axle overlapping the axle can be interconnected by inboard linkage with a like cam lobe mounted on a second axle journalled a spaced distance from the first axle, or with cam lobe members on additional axles, for positive rotation of one or more axles by a driving axle. A hoist drum mounted concentric with at least one of the driven and driving axles can be rotated in unison with the other axle to wind or unwind one or more cables thereon for raising or lowering scaffolding to which the cables are connected.

More particularly, the drive mechanism of the invention for rotating a plurality of hoist drums in unison comprises the combination of at least two axles journalled for rotation in a frame, said axles journalled in a parallel, spaced-apart relation; a drum adapted to receive a cable wound thereon mounted on at least one axle concentric therewith; at least one circular cam lobe mounted eccentrically on each axle overlapping the said axle, said cam lobes having the same eccentricity relative to the axis of each axle; and an inboard link plate interconnecting a cam lobe on each axle in rotatable relationship whereby oscillatory motion imparted to the link plate by rotation of one of said axles rotates the other axle in unison.

Each axle may have one or more circular cam lobes mounted eccentrically thereon to overlap the axle. Two cam lobes mounted eccentrically on each axle would preferably be angularly displaced, i.e. out of phase, about 90° to each other. Three cam lobes mounted eccentrically on each axle would be angularly out of phase about 120° with each other and four or more cam lobes would in like manner be out of phase equally angularly with each other.

Each cam lobe is of the same diameter and has the same degree of eccentricity relative to the axis of each axle.

The cam lobe drive system of the invention preferably utilizes three equispaced cam lobes mounted on each axle and attached directly to a drum end flange. The cam lobes are sufficiently large to overlap the shaft permitting the drive link plates to function inboard of the end of each shaft adjacent to the drum end flange in proximity to each other, as compared to conventional drive mechanisms which are mounted independently of and located outboard of the drum drive shaft to avoid interference of links with shafts. The direct connection of the link plates to the drums through the cam lobes provides maximum safety while the cooperative and concurrent use of three driving elements ensures uniform power transmission.

The combination of three cam lobes mounted on and overlapping an axle, each cam lobe 120° angularly out of phase with the adjacent cam lobe, and having the same degree of eccentricity relative to the axis of the axle, interconnected with a like set of cam lobes mounted on a second axle journalled a spaced distance from the first axle, or with cam lobes on additional axles, provides positive and uniform rotation of one or more axles by a driving axle. A hoist drum mounted concentric with each of the said driven and driving axles can be rotated in unison to wind or unwind one or two pairs of cables thereon for raising or lowering scaffolding to which the cables are connected.

Preferably, the drive mechanism of my invention for rotating a plurality of hoist drums in unison comprises the combination of at least two axles mounted for rotation in a frame, said axles journalled in a parallel, spaced-apart relation; a drum adapted to receive a cable wound thereon mounted on at least one said axle concentric therewith; three circular cam lobes of equal diameter rigidly mounted in proximity to each other on and overlapping each of said axles 120° angularly out of phase with each other, said cam lobes having the same eccentricity relative to the axis of each axle; three inboard link plates each interconnecting a cam lobe on each axle in rotatable relationship whereby oscillatory motion imparted to the link plates by rotation of one of said axles rotates the other axle in unison; means for driving one of said axles; and brake means for retarding the oscillatory motion of the link plates for slowing or stopping rotation of the drums.

The operation of the three drive link plates in proximity to each other enables the use of a novel brake system in combination therewith which, in acting on the drive plates or on extensions of the drive plates in unison, or on an axle interconnected with the drums, positively and directly engages all drums. Thus a single brake system can be used to reliably control a plurality of drums.

A brake unit and a single drive link plate is capable of transferring full braking or driving force to all drums through a single plate and cooperating cams. The use of an axial brake unit having components which are normally frictionally engaged provides sliding frictional motion only during positive braking of the hoist and permits factory presetting of the assembly.

Large cam lobes are not subjected to high operating pressures which are encountered by close tolerance gear teeth. The need for close tolerances and sophisticated and expensive lubrication systems can be obviated and extended life and reliability attained.

Levelwind devices which are positively driven usually are required by regulation to lead suspension cables on the hoist drums. The cam lobe drive elements of the present invention can be used to drive a controlling lead screw which is readily coordinated with the hoist drums.

Multiple drum hoist systems permitted by the present apparatus allows the use of smaller drum diameters with a corresponding reduction in driving torque. This lower torque requirement reduces the size and cost of the primary drive employed to couple the drive motor to the hoist drums. Also, the use of a multiple drum system results in a significant reduction in overall size compared to a single drum unit.

It is therefore a principal object of the present invention to provide a drive mechanism for a hoist drum system which is simple, reliable and safe in operation and relatively light and compact in weight and size.

These and other objects of the invention and the manner in which they can be attained will become apparent from the following detailed description of the drawings, in which.

Figure 1:
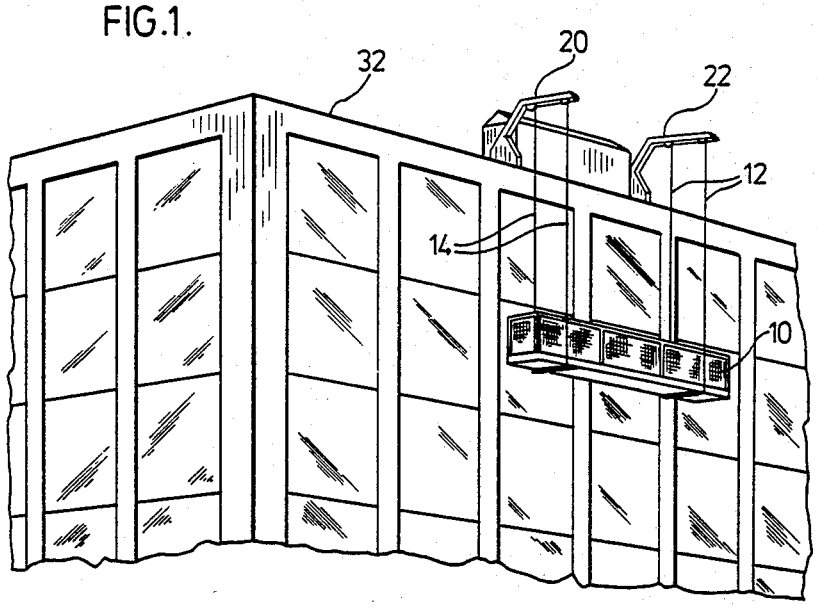
FIG. 1 is a perspective view of a hoist system for use in raising and lowering scaffolding for cleaning windows in tall buildings, well known in the art.
Figure 2:
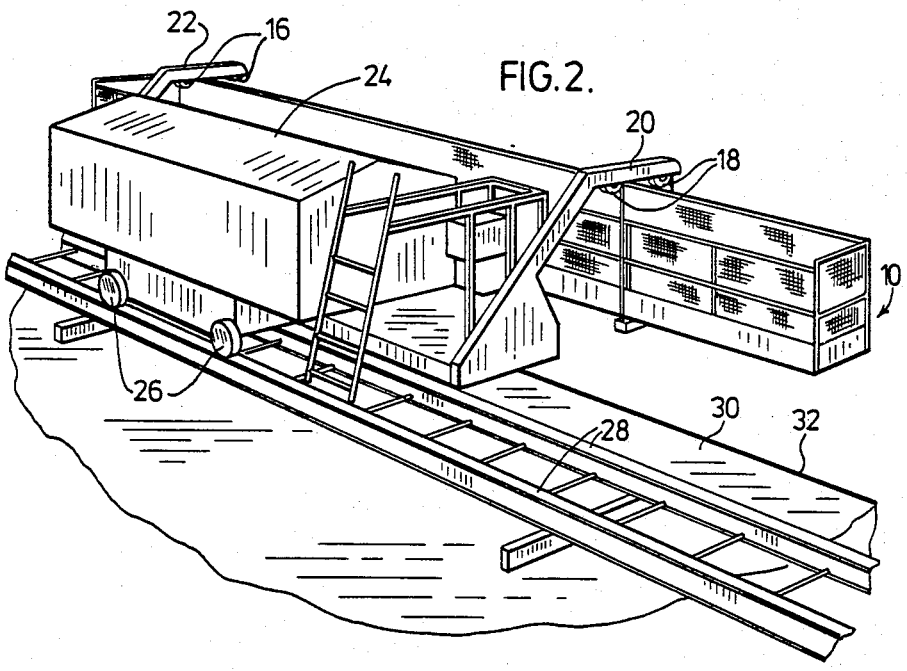
FIG. 2 is a perspective view of the assembly shown in FIG. 1 indicating the manner in which the hoist system may be rail mounted.

With reference now to FIGS. 1 and 2, a conventional hoist system for raising and lowering scaffolding and the like staging from the top of buildings comprises scaffolding 10 having a pair of cables 12,14 in proximity to each end of the scaffolding for raising and lowering the scaffolding while maintaining the scaffolding in a horizontal, stable position. Cables 12,14 pass over pulleys 16,18 respectively which are journalled for rotation in support arms 20,22. Support arms 20,22 are carried by a carriage 24 having wheels 26 for traversing rails 28 permanently affixed to roof 30 parallel to the roof edge 32. A hoist (not shown) rotatably mounted within housing 24 receives cables 12,14 wound thereon for raising and lowering scaffolding 10.

Figure 3:
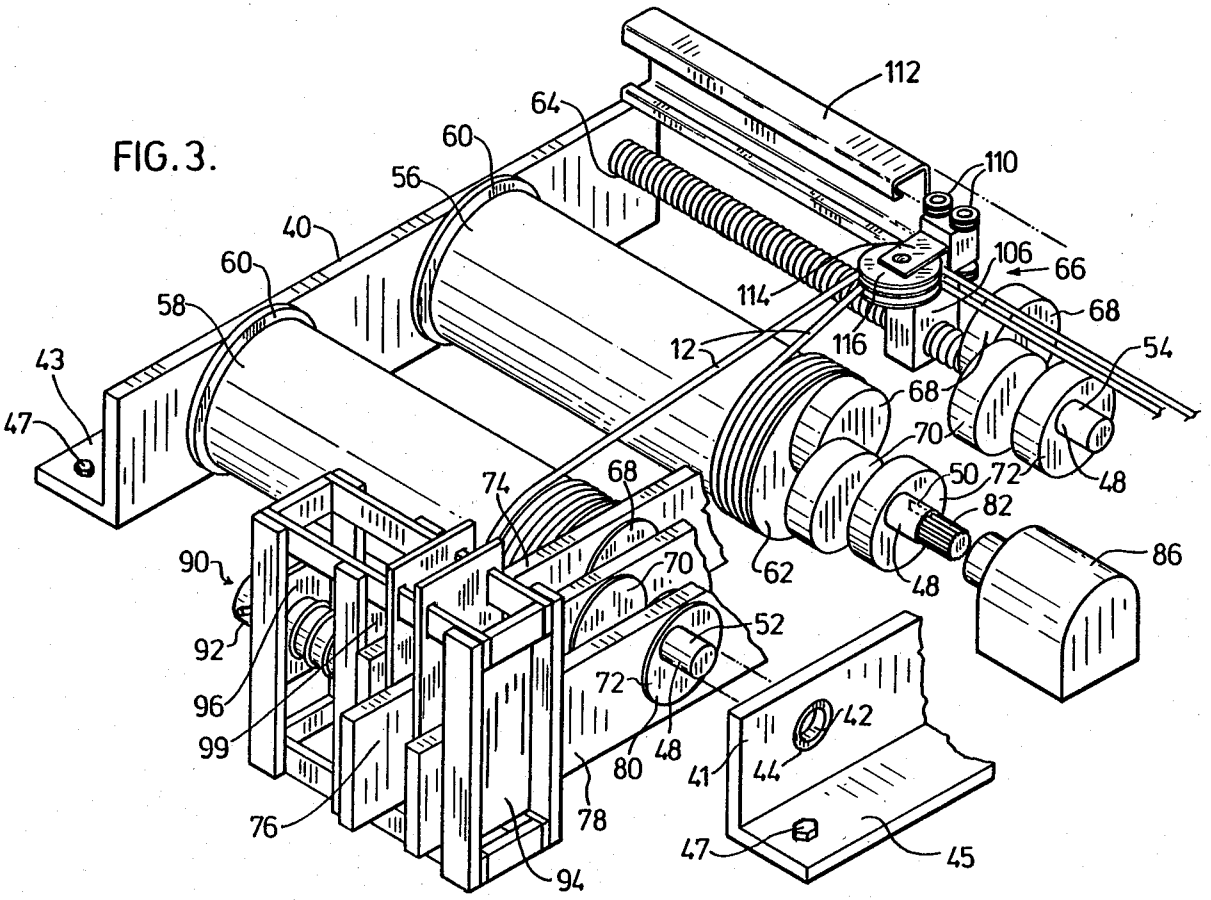
FIG. 3 is a perspective view of a preferred embodiment of the present invention, partly broken away, illustrating the drive mechanism.
Figure 4:
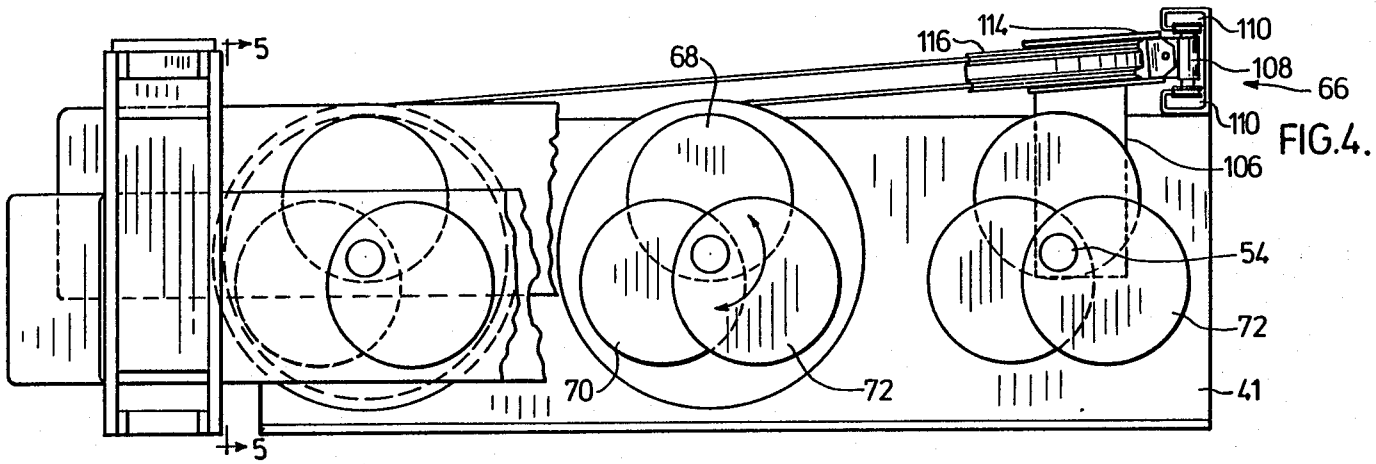
FIG. 4 is a side elevation, partly cut away, of the embodiment of the invention illustrated in FIG. 3.
Figure 5:
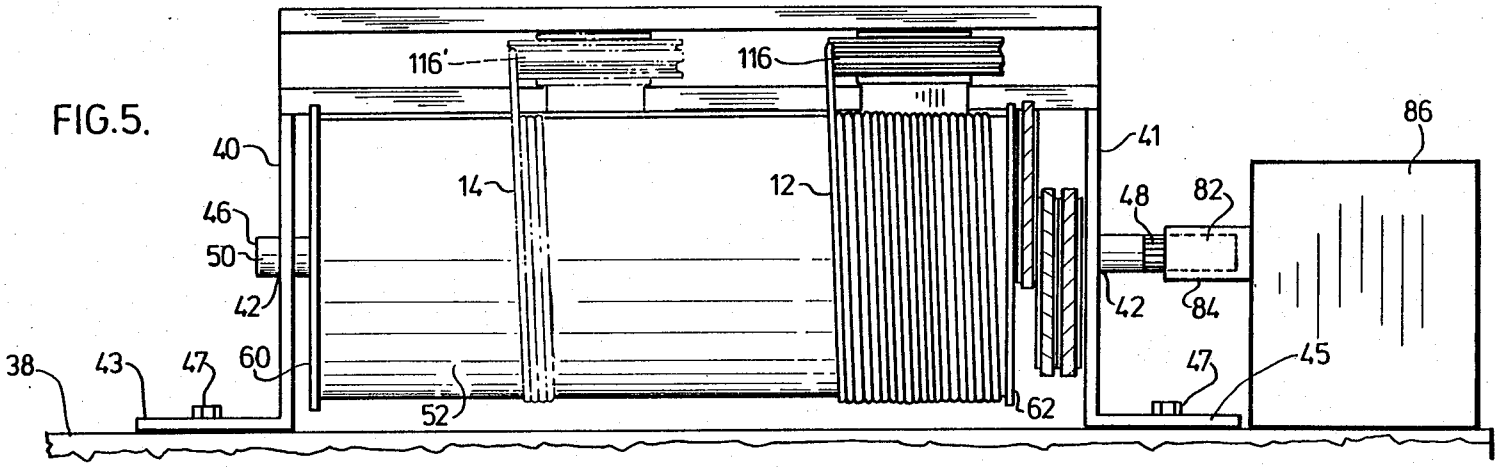
FIG. 5 is a transverse section taken along the line 5—5 of FIG. 4 indicating by ghost lines the winding of a pair of hoist cables on a drum.

With reference now to FIGS. 3–6, the embodiment of the apparatus of the invention illustrated comprises a frame having spaced-apart, parallel support side walls 40,41 affixed to a support carriage 38, FIG. 5, by flanges 43,45 and connectors 47. Side walls 40,41 have openings 42 formed therein with bearings 44 for receiving the ends 46,48 of each of shaft 50, 52 and 54. Shafts 50,52 have drums 56,58 mounted concentric thereon by drum end flanges 60,62 secured onto the shafts. Shaft 54 has an external thread 64 formed along the length thereof to receive levelwinder 66, to be described.

Each of axles 50, 52 and 54 has three cam lobes 68, 70 and 72 mounted thereon about 120° out of phase with the adjacent cam lobe and with the same degree of eccentricity relative to the axis of the respective shafts.

Cam lobes 68, 70 and 72 have the same diameter and are secured adjacent each other. Cam lobes 68 preferably are permanently secured to the drum end flanges 62 or comprise an integral part thereof and cam lobes 70,72 are mounted on the shafts by means of splines, well known in the art, such that these cam lobes can be removed for servicing and/or replacement. All cam lobes overlap the axles.

The cam lobes depicted by like numbers 68, 70 and 72 are in planar alignment with each other and are interconnected by inboard drive links 74, 76 and 78, respectively, each drive link having circular openings 80 formed therein adapted to loosely receive the cam lobes for oscillatory rotation. The term "inboard" used herein in connection with the links means the links oscillate about the shafts inboard of the ends of the shafts, as permitted by the overlap of the cam lobes with the axles.

Figure 6:
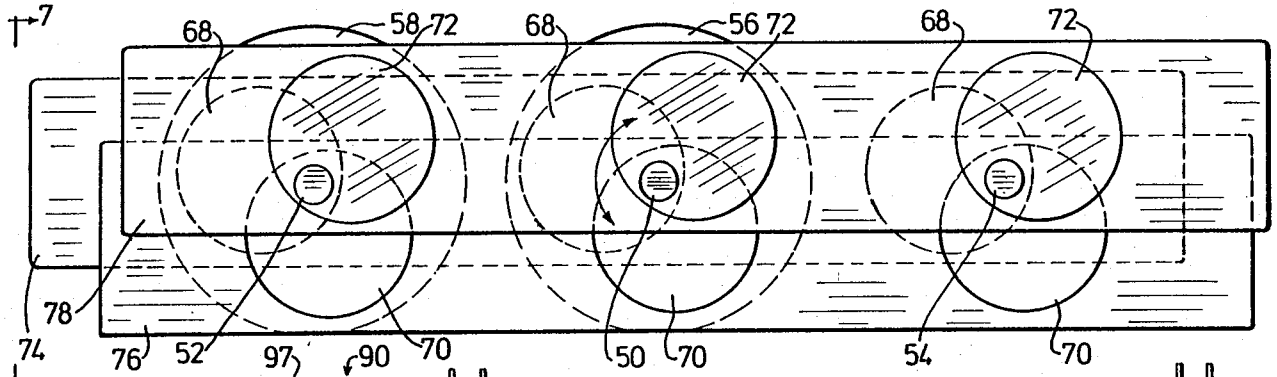
FIG. 6 is a side view of the apparatus as illustrated in FIG. 4 showing the inboard link plates interconnecting the axle cams.

It will be evident that as drive shaft 50 rotates about its axis, cam lobes 68, 70 and 72 will rotate therewith in an eccentric manner converting rotation of shaft 50 to oscillatory movement of drive links 74, 76 and 78 whereby following cam lobes 68, 70 and 72 and driven shafts 52,54 will be rotated in unison with shaft 50, as shown most clearly in FIG. 6.

Shaft 50 has spline extension 82 or a keyed shaft extension adapted to be received in coupling 84 of drive motor gear reducer 86 for positive rotation of shaft 50.

Figure 8:
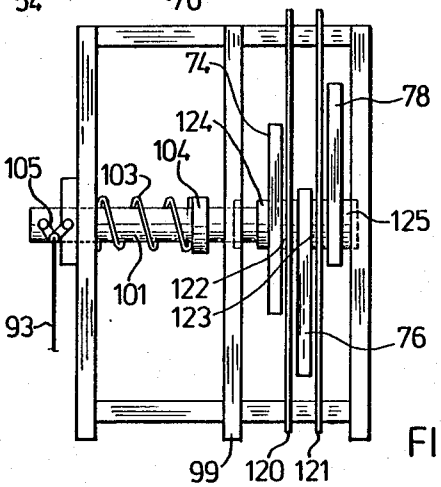
FIG. 8 is an end view corresponding to FIG. 7 showing the brake mechanism in its operative, braking position.
Figure 7:
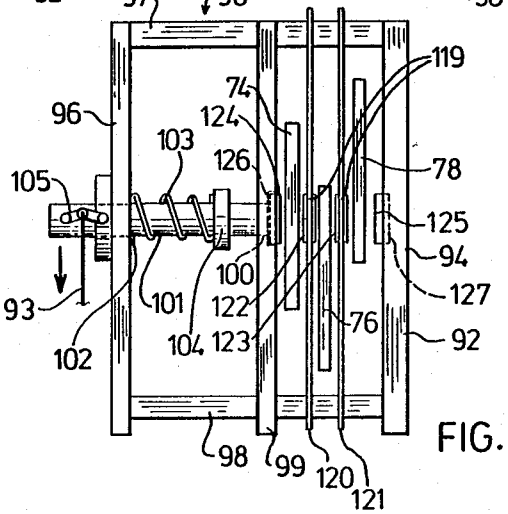
FIG. 7 is an end view of an embodiment of the invention, such as typified in FIG. 6, showing a brake system of the invention in an inoperative position.

Caliper brakes depicted by numeral 90, shown most clearly in FIGS. 3, 7 and 8, comprise housing 92, rigidly mounted on a support frame, not shown, within which links 74, 76 and 78 oscillate. Housing 92 comprises a pair of end plates 94,96 having upper and lower pairs of parallel slide rods 97,98 secured thereto. Intermediate plate 99 rigidly connected to rod pairs 97,98 has an opening 100 formed therein for slidably receiving plunger rod 101 which projects into housing 90 through opening 102 in plate 96. A compression spring 103 is mounted concentric with rod 101 within housing 90 and secured to rod 101 by ring 104 such that rod 101 is biased to the right as viewed in FIG. 7.

An over-centre release 105 is mounted externally of housing 90 such that longitudinal movement of rod 93 in the direction of the arrow will release plunger 101 and permit the plunger to move to the right, as shown in FIG. 8.

A pair of slide plates 120,121 loosely mounted on rod pairs 97,98 support friction or brake pads 122,123 positioned and supported in openings 119 formed in plates 120,121. A pair of brake pads 124,125 are positioned in recesses 126,127 formed in plates 99,94. Actuation of arm 93 during an emergency stop by an over-speed sensing device, well known in the art, allows rod 101 to be biased to the position indicated in FIG. 8 whereby the oscillatory travel of links 74, 76, 78 is stopped by the frictional engagement of the brake pads on the links, or their extension.

With specific reference now to FIGS. 3 and 4, level-winder 66 comprises a support block 106 threaded onto shaft 54 for axial reciprocal travel along shaft 54 as the shaft is rotated by the connecting links. Block 106 has a carriage 108 with two spaced-apart pairs of rollers 110 mounted thereon adapted to travel within channel track 112 to maintain block 106 in an upright position. Carriage 108 has bracket 114 with double-grooved pulley 116 journalled therein for leading cables 12 or 14 to drums 56,58.

FIG. 5 illustrates another embodiment of the invention in which a pair of spaced double-grooved pulleys 116,116' lead cables 12,14 onto drum 52 to represent the winding of the four support cables 12,14 on a pair of drums.

Figure 9:
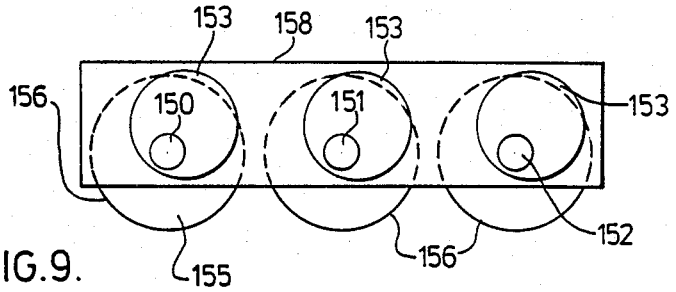
FIG. 9 is a side elevation of another embodiment of the invention showing a single cam lobe on each axle.

FIG. 9 shows an embodiment of the invention in which each axle 150,151 and 152 has a single cam lobe 153 mounted thereon and secured to the end flange 155 of each drum 156. Link 158 interconnects the cam lobes in a driving relation as has been discussed above.

Figure 10:
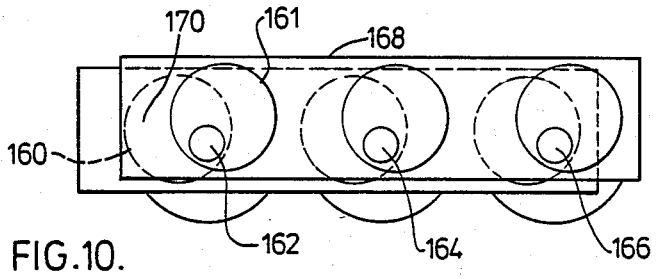
FIG. 10 is a side elevation of a further embodiment of the invention illustrating a pair of cam lobes on each axle.

FIG. 10 shows another embodiment in which a pair of cam lobes 160,161 at about 90° angular displacement to each other are mounted on shafts 162, 164 and 166 and interconnected by links 168,170.

Figure 11:
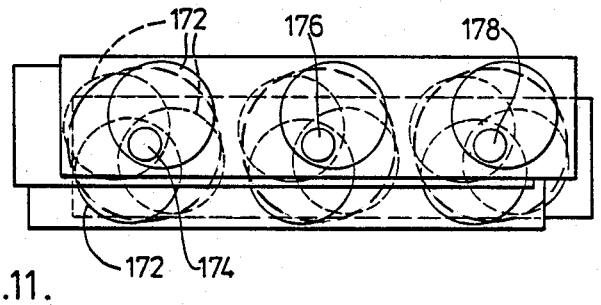
FIG. 11 is a side elevation of still another embodiment of my invention in which four cam lobes are mounted on each axle.

Four cam lobes 172 are mounted on the axles 174, 176 and 178 of the embodiment of the invention shown in FIG. 11. In all embodiments, the cam lobes overlap the axles permitting the link plates to oscillate inboard of the ends of the axles.

Figure 12:
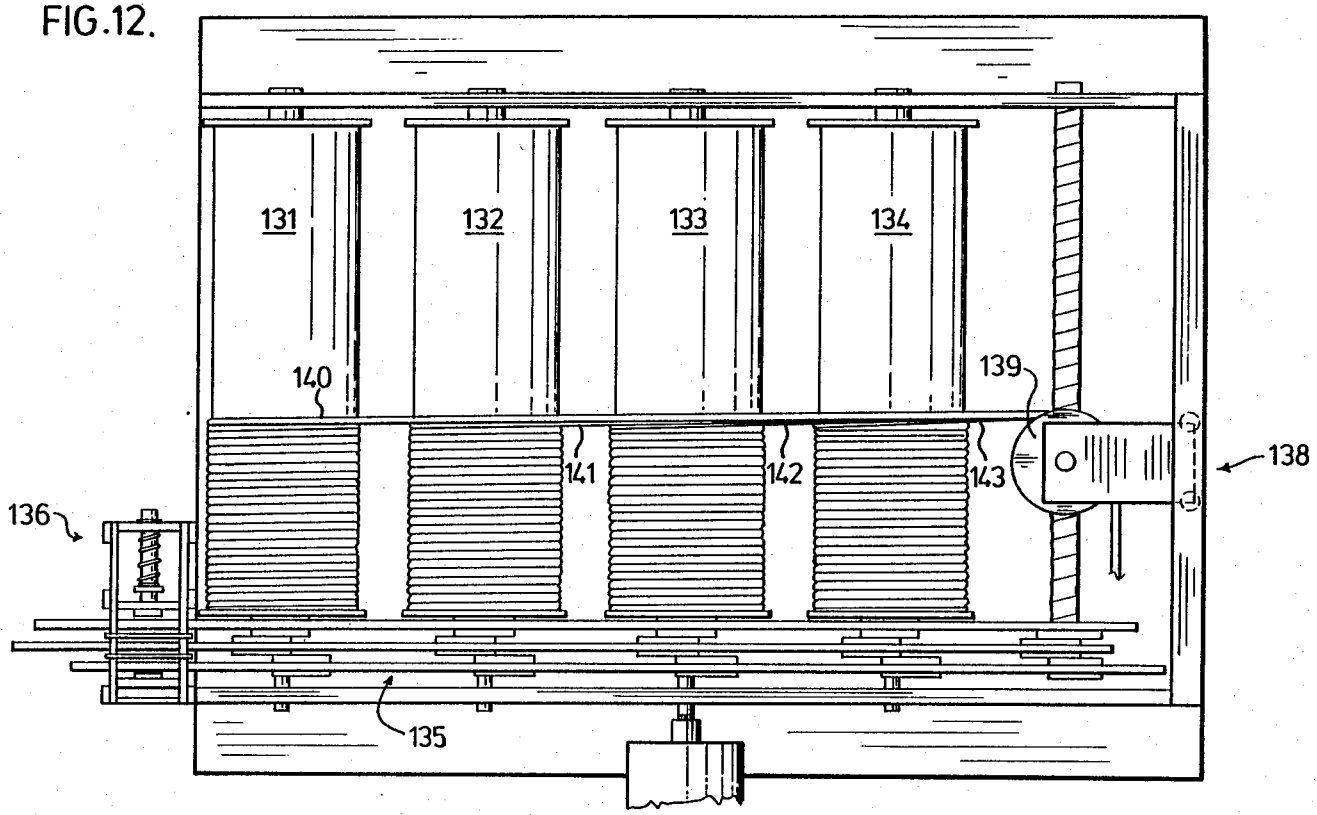
FIG. 12 is a plan view of an embodiment of the present invention having four hoist drums.

FIG. 12 shows an embodiment of the invention in which four drums 131, 132, 133 and 134 are driven in unison by the drive system of the invention depicted by numeral 135. Brake 136 effectively controls braking of all drums 131–134 through the connecting links. Level-winder 138 with four-groove pulley 139 leads cables 140, 141, 142 and 143 in vertical alignment with each other to the drums 130–134.

Figure 13:
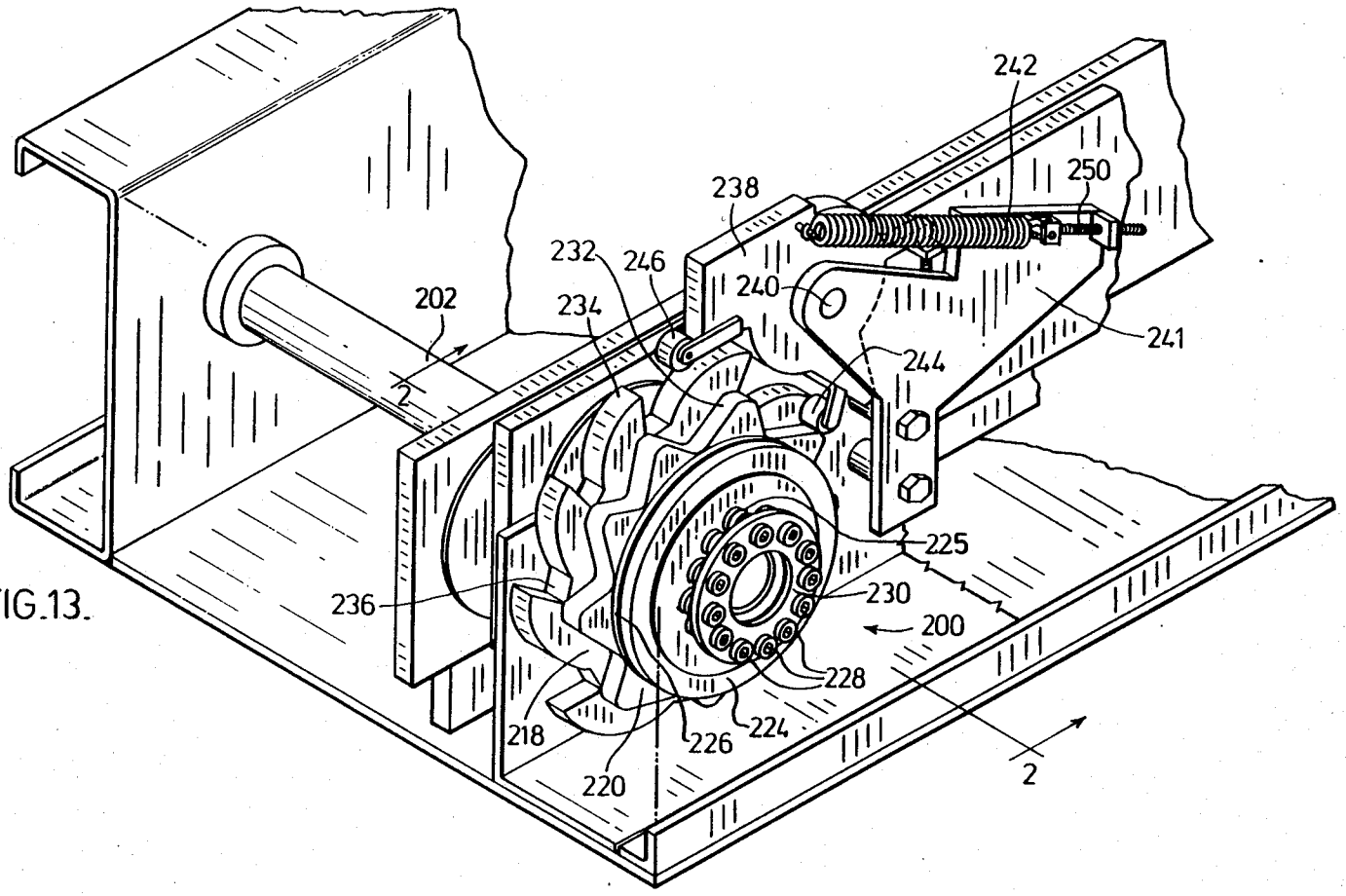
FIG. 13 is a perspective view of another embodiment of brake mechanism.
Figure 14:
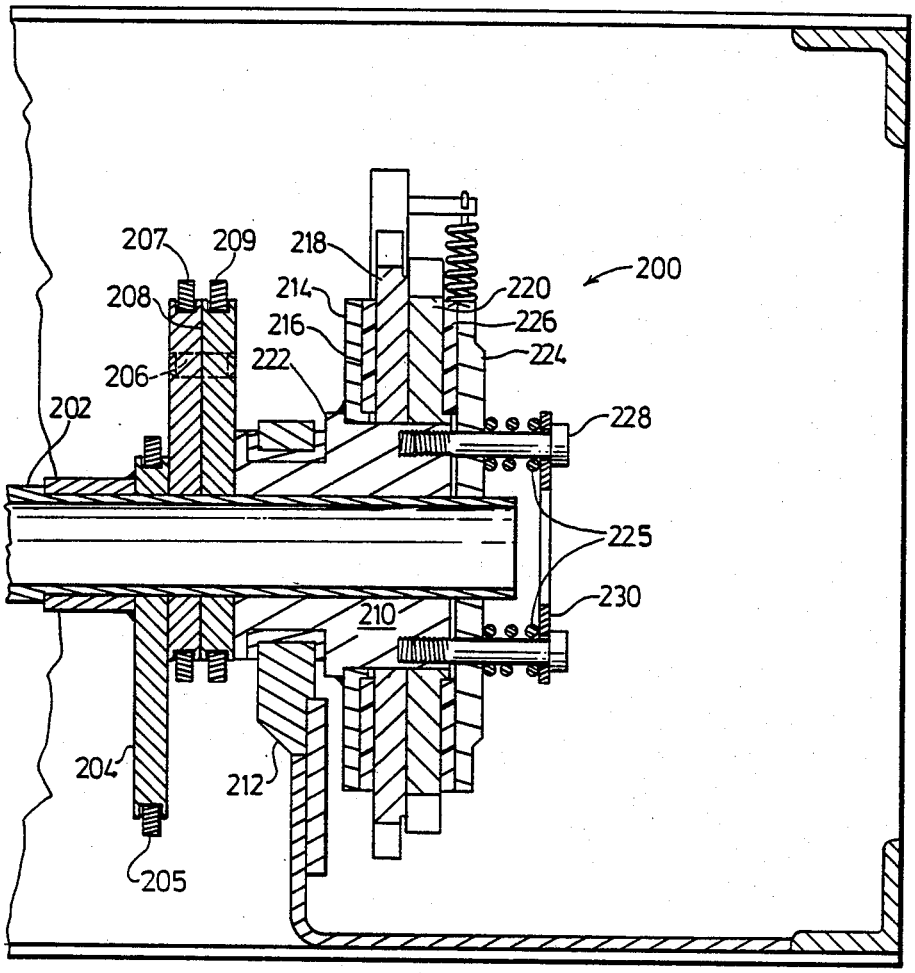
FIG. 14 is a sectional view of the brake mechanism taken along line 14—14 of FIG. 13.
Figure 15:
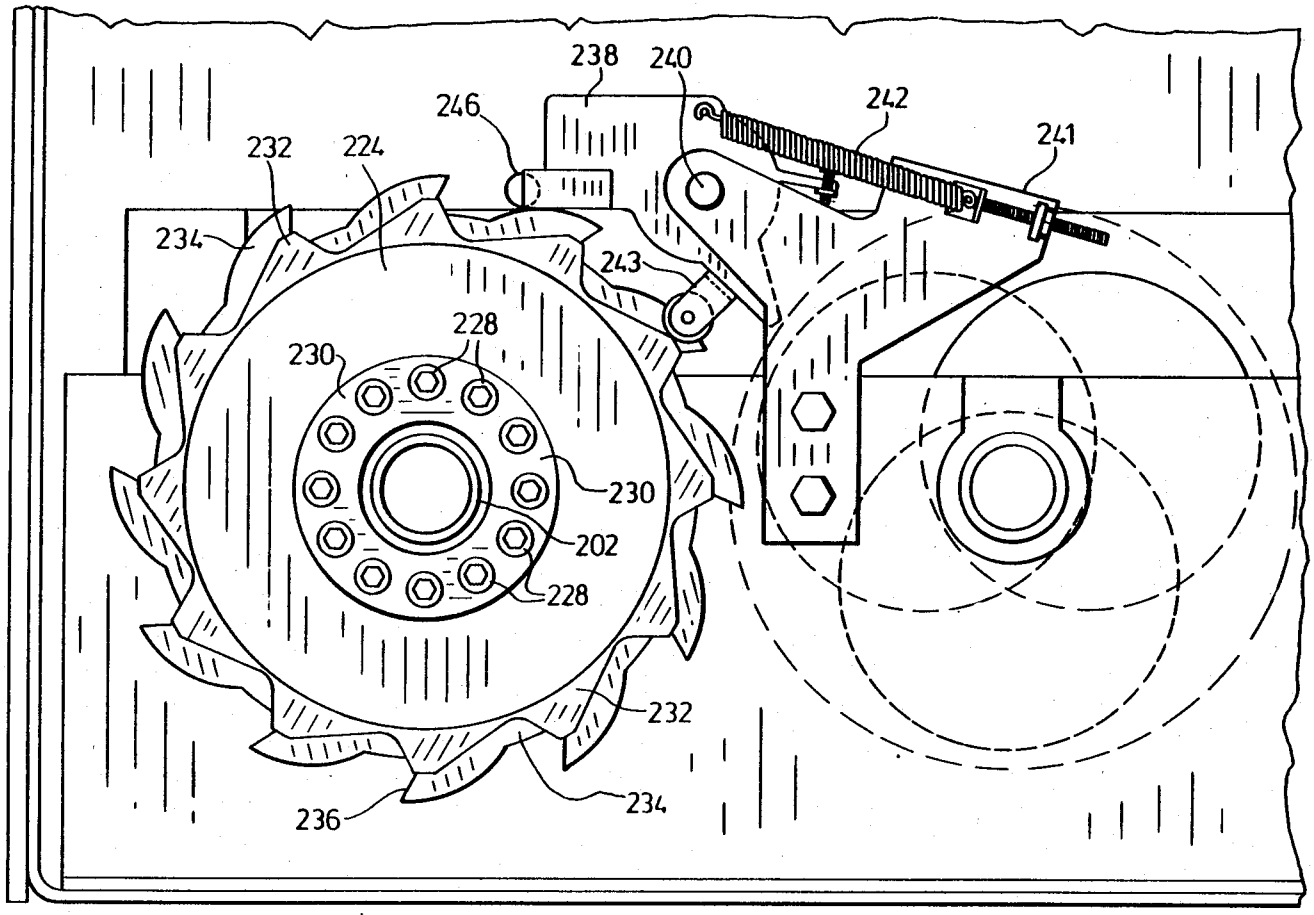
FIG. 15 is a side elevation of the said brake mechanism shown in FIG. 13.

Another embodiment of brake mechanism shown in FIGS. 13–17 comprises the mechanism depicted by numeral 200 mounted axially on a shaft 202 (or drum axle) having three cam lobes 204,206 and 208 rigidly secured together with link plates 205,207 and 209 interconnecting said lobes to corresponding lobes of parallel axles, as shown more clearly in FIGS. 13 and 14.

A hub 210 mounted concentrically on shaft 202 for rotation therewith and rigidly secured to cam lobe 208 is journalled in support bushing 212. Hub 210 carries a backing plate 214 having a friction disc 216 and a pair of abutting control discs 218,200 which are keyed together, such as by the use of dowels. Backing plate 214 is rigidly secured to hub 210 and discs 218,220 are slidably mounted for rotation on hub 210. Pressure plate 224 having friction disc 226 is slidably mounted on shaft 202 in abutment against disc 220 and is biased against disc 220 by a plurality of compression springs 225 mounted coaxial with equispaced bolts 228 loosely passing through plate 224 and threaded into hub 210. Springs 225 are compressed between ring 230 and pressure plate 224 to a predetermined setting whereby coupled discs 218,220 normally rotate with hub 210 due to the frictional engagement of abutting friction discs 216,226 therewith.

Figure 16:
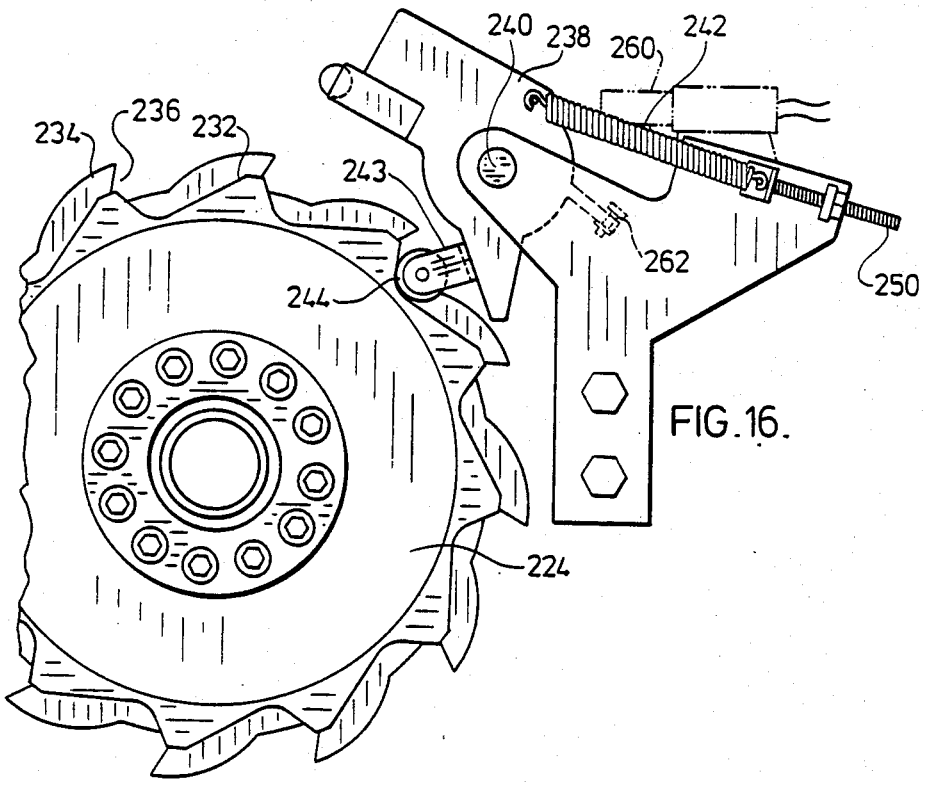
FIGS. 16 and 17 are side elevations showing operation of the sensor-actuator.

Disc 220 has a plurality of equispaced cams, i.e. cam lobes 232, formed on its perimeter and disc 218 has a plurality of corresponding dogteeth 234 defining notches 236 formed on its perimeter. Sensor-actuator 238 pivotally-mounted on shaft 240 carried by stationary bracket 241 is biased in a clockwise direction, as viewed in FIG. 13, by tension spring 242 such that cam arm 243 having cam follower 244 journalled thereon rides on cam lobes 232. As cam follower 244 rides up on a cam lobe 232, sensor-actuator 238 pivots about shaft 240 against the bias of spring 242 to align engagement roller 246 with a notch 236 until cam follower 244 rides down the opposite side of the cam lobe 232 to pivot the sensor-actuator 238 in the opposite direction so that engagement roller 246 passes over notch 236 and tooth 234, as shown in FIG. 16.

The tension of spring 242 is adjusted by the axial movement of threaded bolt 250 connected thereto such that cam follower 244 tracks lobes 232 up to a predetermined rotary speed of shaft 202.

Figure 17:
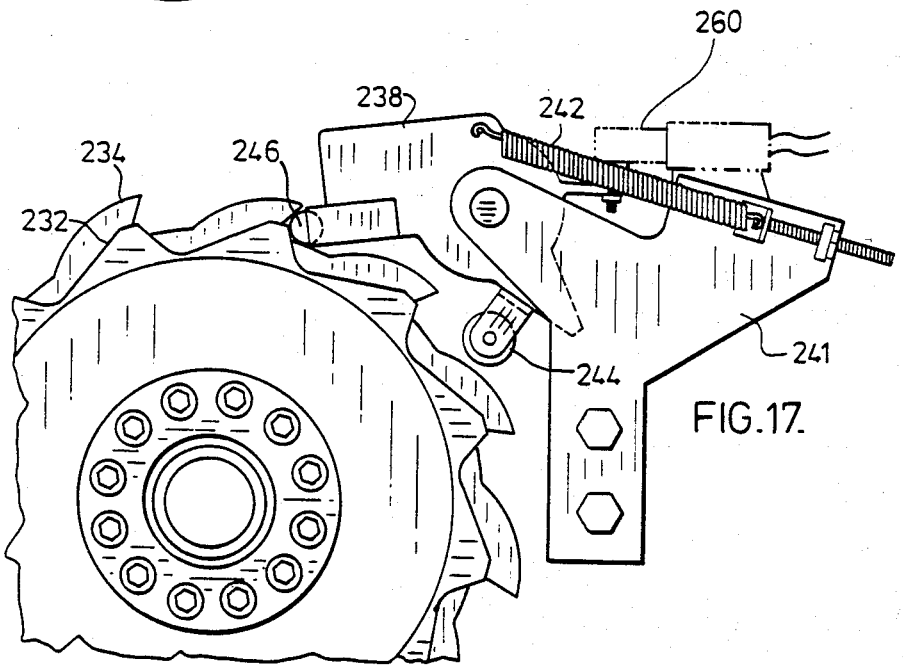

As the rotary speed of shaft 202 and disc 220 increases, the inertia of oscillating sensor-actuator 238 causes the cam follower 244 to leave the surface of cam lobe 232 which in turn causes engagement roller 246 to contact the approaching face of dogtooth 234, as shown in FIG. 17. The acute angle defined by the face of notch 236 positively seats engagement roller 246. Discs 218,220 are prevented from further rotation causing friction discs 216,226 to in turn transmit frictional resistance to plates 214,224 which through their interconnection to the drive system by way of hub 210, cam lobes 204,206 and 208, and link plates 205,207 and 209, bring the hoist to a smooth and rapid stop.

Concurrent with the positive braking action initiated by sensor-actuator 238 in the position shown in FIG. 17 is the opening of limit switch 260 electrically connected to the hoist drive motor by actuator 262 depending from sensor-actuator 238. Thus stopping of rotation of the hoist drums is accompanied by de-energization of the hoist drive motor.

What I claim as new and desire to protect by Letters Patent of the United States is:

1. A drive mechanism for a plurality of hoist drums for rotating said drums in unison comprising, in combination, a frame having a pair of spaced-apart, parallel support side walls, at least two axles journalled for rotation in said support walls of the frame, said axles journalled in a parallel, spaced-apart relation;

a drum adapted to receive a cable wound thereon mounted on at least one said axle concentric therewith;

three circular cam lobes of equal diameter rigidly mounted eccentrically on each of said axles between said support walls 120° angularly out of phase with each other, said cams having the same eccentricity relative to the axis of each axle;

three elongated link plates each having at least two circular holes formed therein adapted to receive and to interconnect the cam lobes on the axles inboard between the support walls in rotatable relationship whereby oscillatory motion imparted to the link plates by rotation of one of said axles rotates the other axle in unison;

means for driving one of said axles; and brake means for retarding the oscillatory motion of the link plates for slowing or stopping rotation of the drums, said brake means comprising a hub mounted on a said axle and rigidily secured to the cam lobes for rotation with the said cam lobes, cam means and detent means mounted on the hub for rotation thereon, and friction discs rigidly mounted on the hub for rotation therewith, said friction discs adapted to engage the cam means and detent means in frictional engagement for normal conjoint rotation together, and said cam means and detent means comprising a pair of control discs secured together for conjoint rotation, one of said discs having a plurality of equispaced cam lobes formed on its perimeter and the other of said discs having a plurality of corresponding dogteeth defining notches formed on its perimeter, a sensor-actuator having a cam follower and an engagement roller extending therefrom, said sensor-actuator being pivotally mounted and biased for rotation whereby said cam follower is urged against the disc cam lobes and tracks said lobes up to a predetermined rotary speed of the control discs and said cam follower leaves the surface of the cam lobes in excess of said predetermined rotary speed to cause the engagement roller to seat in a dogtooth to prevent further rotation of said discs and to cause the friction discs to stop rotation of the hub and the cam lobes secured thereto.

2. A drive mechanism as claimed in claim 1 in which the three circular cam lobes rigidly mounted on each of the axles are mounted in proximity to each other whereby the link plates are operatively mounted for oscillatory motion in proximity to each other and one of said circular cam lobes is permanently attached to or is integral with a drum.

3. A drive mechanism as claimed in claim 1 in which the three circular cam lobes rigidly mounted on each axle are secured to each other to form an integral structure.

4. A drive mechanism as claimed in claim 1 in which the frame comprises a pair of spaced-apart structural members having bearings mounted therein for journalling the axles, and an additional axle journalled in the frame for rotation in the frame in a parallel, spaced-apart relation to the other axles, said additional axle having a screw thread formed on its surface, a levelwinder threaded onto said additional axle, means for guiding said levelwinder in reciprocal travel on said axle, three circular cam lobes of equal diameter rigidly mounted eccentrically on said additional axle 120° angularly out of phase with each other, said cams having the same eccentricity relative to the axis of the axle, and the said link plates interconnecting the cams on the additional axle with the cams on the other axles.

5. A drive mechanism as claimed in claim 1 in which said friction discs comprise a first friction disc mounted on a backing plate rigidly secured to the hub for positive rotation with the hub and a second friction disc mounted on a pressure plate secured to the hub for rotation therewith, said pressure plate having means for biasing the second friction disc towards the first friction disc, said backing plate and pressure plate mounted on the hub to frictionally engage the control discs therebetween.

* * * * *